US011408295B2

(12) United States Patent
Guerard et al.

(10) Patent No.: US 11,408,295 B2
(45) Date of Patent: Aug. 9, 2022

(54) NOZZLE FOR A TURBINE, TURBOMACHINE TURBINE EQUIPPED WITH SAID NOZZLE AND TURBOMACHINE EQUIPPED WITH SAID TURBINE

(71) Applicant: SAFRAN AIRCRAFT ENGINES, Paris (FR)

(72) Inventors: Coralie Cinthia Guerard, Moissy-Cramayel (FR); Hamza Guessine, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/419,404

(22) PCT Filed: Dec. 30, 2019

(86) PCT No.: PCT/FR2019/053317

§ 371 (c)(1),
(2) Date: Jun. 29, 2021

(87) PCT Pub. No.: WO2020/141284

PCT Pub. Date: Jul. 9, 2020

(65) Prior Publication Data

US 2022/0074312 A1 Mar. 10, 2022

(30) Foreign Application Priority Data

Dec. 31, 2018 (FR) ..... 1874402

(51) Int. Cl.
*F01D 9/04* (2006.01)
*F01D 11/12* (2006.01)
*F01D 11/00* (2006.01)

(52) U.S. Cl.
CPC ..... *F01D 9/04* (2013.01); *F01D 11/001* (2013.01); *F01D 11/125* (2013.01);
(Continued)

(58) Field of Classification Search
None
See application file for complete search history.

(56) References Cited

U.S. PATENT DOCUMENTS 4,239,451 A * 12/1980 Bouru ..... F01D 11/025 415/173.7
6,220,815 B1 * 4/2001 Rainous ..... F16B 5/0241 416/204 R (Continued)

FOREIGN PATENT DOCUMENTS

EP 0017534 A1 * 10/1980 ..... F01D 11/02
FR 3003599 A1 9/2014

OTHER PUBLICATIONS

French Search Report for FR 1874402 dated Sep. 20, 2019.
International Search Report for PCT/FR2019/053317 dated Mar. 17, 2020 [PCT/ISA/210].

*Primary Examiner* — Courtney D Heinle
*Assistant Examiner* — Jason Fountain
(74) *Attorney, Agent, or Firm* — Sughrue Mion, PLLC

(57) ABSTRACT

The invention concerns a turbine nozzle, comprising a plurality of angular nozzle sectors (6) each angular sector (6) comprising two inner and outer platform sectors, connected together by a plurality of radial blades (63), each inner platform sector (62) being rigidly attached to a radially inner foot (621), this nozzle comprising an annular collar (5) on which the nozzle angular sectors are fastened end-to-end circumferentially, this collar (5) comprising a cylindrical ring (50) the radial inner face (51) of which comprises an abradable material (53). This nozzle is characterised in that the radially inner foot (621) of each inner platform sector comprises a radial tab (622) and in that the annular ring (50) comprises a plurality of L-shaped pads (55), each pad
(Continued)

delimiting a slot (553) for receiving the tab (622), so as to ensure the fastening by coupling of the collar on each nozzle angular sector.

11 Claims, 6 Drawing Sheets

(52) U.S. Cl.
CPC .. *F05D 2220/323* (2013.01); *F05D 2240/128* (2013.01); *F05D 2240/55* (2013.01)

(56) References Cited

U.S. PATENT DOCUMENTS

| | | | | |
|---|---|---|---|---|
| 10,677,080 | B2 * | 6/2020 | Klingels | F02C 7/28 |
| 2004/0169122 | A1 * | 9/2004 | Dodd | F01D 11/127 248/674 |
| 2013/0183145 | A1 | 7/2013 | Caprario et al. | |
| 2015/0003970 | A1 | 1/2015 | Feldmann et al. | |
| 2018/0135449 | A1 * | 5/2018 | Klingels | F02C 7/28 |
| 2018/0340435 | A1 | 11/2018 | Schlemmer et al. | |

* cited by examiner

NOZZLE FOR A TURBINE, TURBOMACHINE TURBINE EQUIPPED WITH SAID NOZZLE AND TURBOMACHINE EQUIPPED WITH SAID TURBINE

CROSS REFERENCE TO RELATED APPLICATIONS

This application is a National Stage of International Application No. PCT/FR2019/053317 filed Dec. 30, 2019, claiming priority based on French Patent Application No. 1874402 filed Dec. 31, 2018, the entire contents of each of which being herein incorporated by reference in their entireties.

GENERAL TECHNICAL FIELD

The present invention relates to a nozzle for a low- or high-pressure turbine, a low- or high-pressure turbine comprising this nozzle and a turbomachine such as an aircraft turbojet or turboprop comprising the above turbine.

PRIOR ART

Some turbomachines comprise a low-pressure turbine and a high-pressure turbine, which recover some of the energy released by the combustion of fuel to drive a low-pressure compressor and a high-pressure compressor respectively, located in the region of the air intake of the turbomachine.

The appended FIG. 1 shows a multi-stage 10 low-pressure turbine 1, each stage 10 comprising successively a nozzle 2 and a rotor wheel 3, from upstream to downstream relative to the direction of flow of air in the turbine (arrow V: that is, from left to right in FIG. 1). All rotors are fixed on a shaft, not shown in the figures and driven in rotation simultaneously.

The low-pressure turbine 1 has a longitudinal axis X-X'.

Each nozzle 2 is sectorised, that is, formed from several angular nozzle sectors 20, arranged circumferentially end-to-end and assembled together.

Each angular nozzle sector 20 comprises two platforms in a portion of an arc of a circle, arranged coaxially one inside the other and connected together by radial or substantially radial blades 201. These platforms delimit between them the annular duct for gas flow in the turbine 1.

The external platform 202 comprises means for hooking onto an external casing 100 of the turbine 1. The internal platform 203 extends towards the interior of the turbine by a radial foot 204 which terminates in a baseplate 205.

On its radially internal face this baseplate 205 bears elements made of abradable material 206. This abradable material is in the form of a honeycomb structure. The elements made of abradable material 206 cooperate with annular sealing lips 30 carried by the adjacent rotor 3 to form sealing joints of "labyrinthine seal" type. In fact, when in operation and under the effect of heat, because the sealing lips 30 and the internal platform 203 dilate and move more closely together, the sealing lips 30 sink furrows into the abradable material 206. Between the furrows and the sealing lips there is slight clearance which constitutes this labyrinthine seal. This clearance engenders the performance of the flow of the hot-air duct which flows in the turbine.

The honeycomb 206 is brazed onto the baseplate 205 of each angular nozzle sector 20, then is renewed by machining. Currently, this material is machined by electro-erosion (known by the acronym EDM for "Electrical Discharge Machining"), which is an expensive technique requiring specific and expensive controls.

Also, in the event of substantial wear of the elements made of abradable material, they need to be replaced by new ones during maintenance operations. It is therefore necessary to disassemble each angular nozzle sector, to machine the worn abradable elements to remove them and to braze new abradable elements onto the internal baseplates of said angular nozzle sectors. This replacement operation is therefore long and costly.

Also, the internal platform 203, the foot 204 and the baseplate 205 of each sector 20 have sealing slots 207 which terminate on each of the end faces of a sector 20 intended to make contact with the end faces of the adjacent sector of nozzle 20. An inter-sector sealing tab (not shown in the figures) is engaged in each sealing slot 207 so as to overlap the space in between two adjacent sectors of nozzle 20 and stop or limit inter-sector air leaks.

The execution and manufacture of the sealing slots 207 as well as installing the inter-sector sealing tabs all come at very high cost and are very time-consuming. The slots 207 are also difficult to dimension and there is the considerable risk that the sealing tabs are dislodged from the sealing slots 207 and become lost in the air duct, resulting in air leaks and possible impacts on the other parts of the turbine.

PRESENTATION OF THE INVENTION

The aim of the invention is to propose a turbomachine nozzle which resolves the above disadvantage of the prior art.

More precisely, the aim of the invention is to provide a turbomachine nozzle which is simple and less costly to produce and assemble while decreasing air leaks in the duct.

Another aim is to simplify maintenance of the nozzle.

For this purpose, the invention relates to a nozzle for a turbine comprising several angular nozzle sectors, each angular sector comprising two sectors of platforms respectively internal and external, in the form of an arc of a circle, coaxial, connected together by several radial or substantially radial blades, each sector of internal platform being attached to a radially internal foot, this nozzle comprising an annular collar to which said angular nozzle sectors are fixed end-to-end circumferentially, this collar comprising a cylindrical ring of which the radially internal face bears an abradable material.

According to the invention, the radially internal foot of each sector of internal platform comprises a tab which extends radially towards the interior from said foot, and which extends circumferentially over part of the length of said foot, the radially external face of said cylindrical ring bearing an external radial wing fitted with a plurality of L-shaped legs of which one of the arms called "fastening" is attached to the external radial wing and extends perpendicularly to a radius of the ring and parallel to the longitudinal axis X1-X'1 of said ring and the other arm of which, called "retaining", extends opposite this external radial wing and at minimal distance from the latter so as to form a slot with it for receiving said tab of each angular nozzle sector, and this slot is open at one of its longitudinal ends to allow engagement of said tab to ensure fastening by coupling of said collar on each angular nozzle sector.

Because of these characteristics of the invention, it is now unnecessary to have sealing slots at the internal ends of the sectors of platforms, or sealing tabs in the latter, since the annular collar extending over 360° ensures this sealing. This reduces flow losses in the duct in this zone.

Finally, this also lowers manufacturing costs of the angular nozzle sectors, their installation and maintenance costs.

According to other advantageous and non-limiting characteristics of the invention, taken singly or in combination:

- said tab of the radially internal foot extends circumferentially over a third of the length of said foot;
- said tab extends circumferentially at the centre of the radially internal foot of each sector of the internal platform;
- the end of the retaining arm is fitted with a lug projecting in the direction of the external radial wing to circumferentially retain said tab when the latter is engaged in the slot for receiving the tab;
- the retaining arm and the external radial wing are connected by a pin, a rivet and/or a weld;
- the nozzle comprises at least one sealing plate, made of at least one segment of L-shaped or substantially L-shaped transverse cross-section, fixed to the radially internal foot of an angular nozzle sector so as to extend at least opposite the intersection between two adjacent angular nozzle sectors;
- the nozzle comprises at least one thermal shielding plate, made of at least one segment of L-shaped or substantially L-shaped transverse cross-section, fixed to the cylindrical ring of the collar.

The invention also relates to a turbomachine turbine comprising the above nozzle and a turbomachine, such as an aircraft turbojet or turboprop, which comprises the above turbine.

DESCRIPTION OF THE FIGURES

Other characteristics and advantages of the invention will emerge from the following description given in reference to the appended drawings which illustrate different possible embodiments by way of non-limiting indication, wherein.

DETAILED DESCRIPTION OF THE INVENTION

Figure 1:
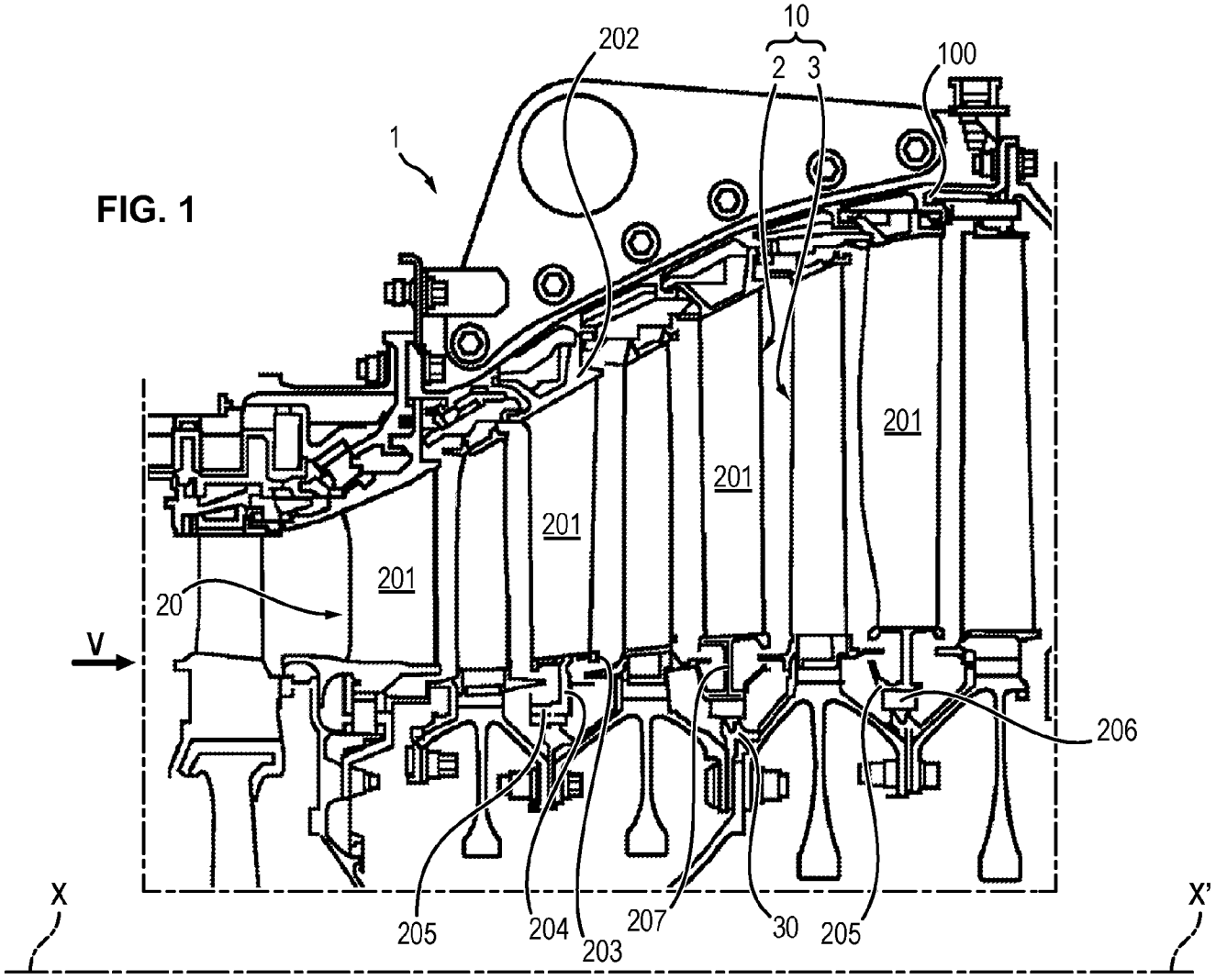
FIG. 1 is a view in longitudinal section of a low-pressure turbine of the prior art.

The nozzle according to the invention is referenced 4 and comprises an annular collar 5, on which several angular nozzle sectors 6 are fixed. Only part of the nozzle 4 is visible in FIG. 9.

The annular collar 5 will now be described in more detail in conjunction with FIGS. 2 to 4. It extends over 360° and has a longitudinal axis X1-X'1.

The annular collar 5 comprises a cylindrical ring 50 (or tube) of minimal width relative to its diameter, of minimal thickness and having a longitudinal axis X1-X'1.

This ring 50 has a radially internal face 51 and a radially external face 52.

Figure 7:
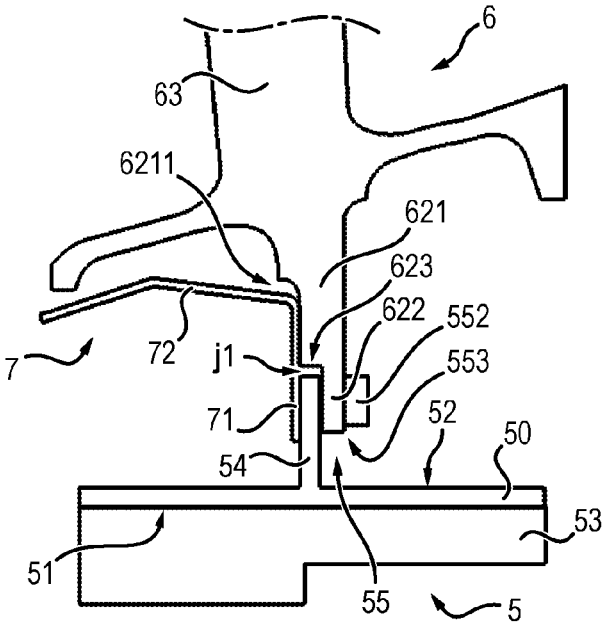
FIG. 7 is a schematic view in axial section of the collar, of the internal part of an angular nozzle sector and a shielding plate joined together, the plate being formed according to a first embodiment.
Figure 8:
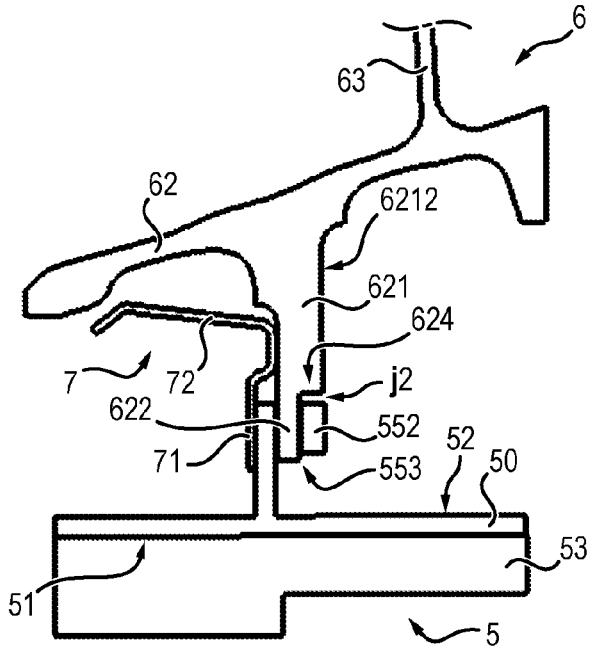
FIG. 8 is a schematic view in axial section of the collar, the internal part of an angular nozzle sector and a shielding plate joined together, the plate being formed according to a second embodiment.
Figure 11:
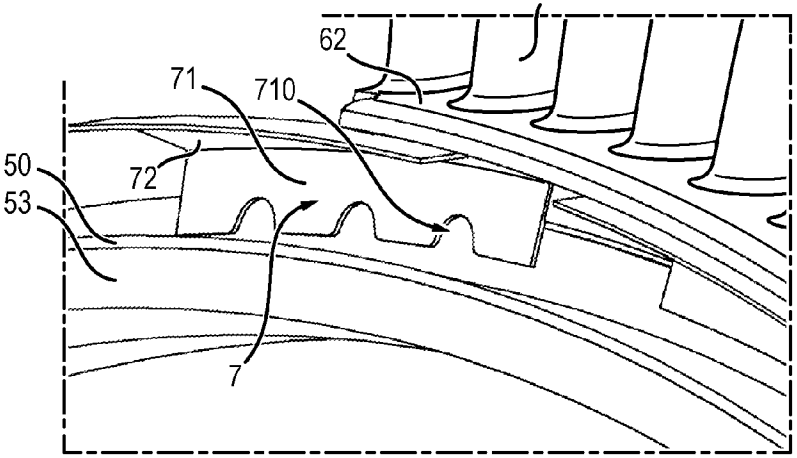
FIG. 11 is a detailed and perspective view of a variant embodiment of a shielding plate assembled on an angular nozzle sector.

As seen more clearly from FIGS. 7, 8 and 11, the internal face 51 bears an abradable material 53 made in one or more elements. This abradable material 53 is preferably a honeycomb structure. It is brazed onto the ring 50 and renewed by machining as described earlier for the abradable material 206. This abradable material 53 is also cylindrical.

The external face 52 of the ring 50 comprises several first mechanical fastening members, distributed over its periphery and intended to cooperate with second complementary mechanical fastening members carried by each of the angular sectors 6.

According to a preferred embodiment of the invention these mechanical fastening members are of "coupling" type and enable the collar 5 and the nozzle sectors 6 to be coupled together by engaging of the tabs in slots for receiving these tabs.

Figure 3:
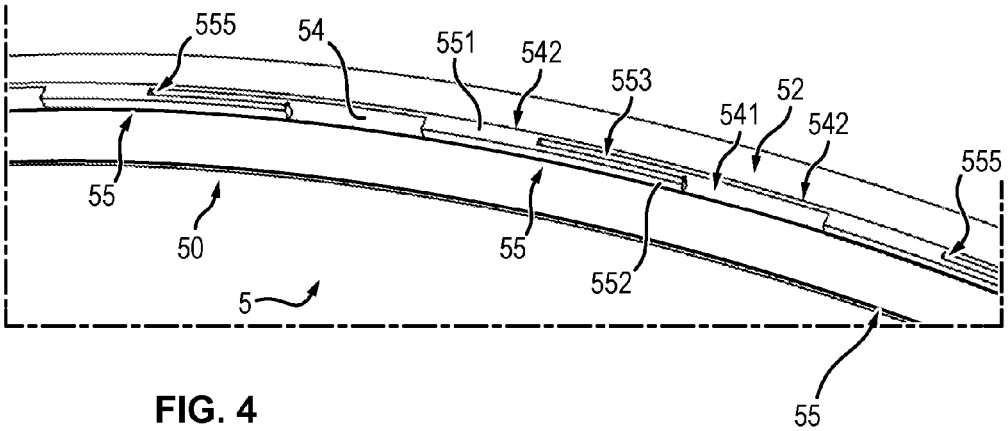
FIG. 3 is a detailed view of FIG. 2.
Figure 4:
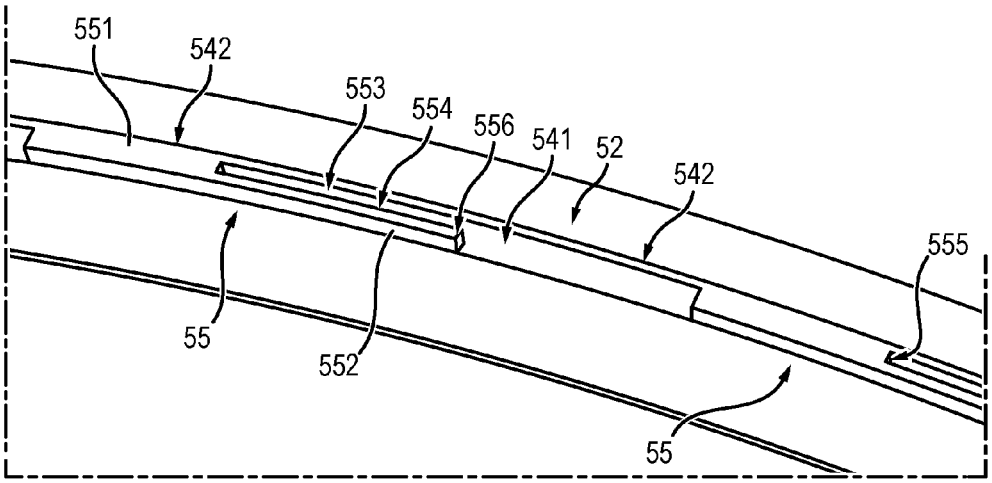
FIG. 4 is a detailed view of FIG. 3.

FIGS. 3 and 4 show that the collar 5 is fitted with a radial wing 54 which extends radially towards the exterior from the external face 52 of the ring 50. This wing 54 is annular and extends over the entire circumference of the ring 50. It has a rear face 541 and an opposite front face 542.

When the nozzle 4 is being mounted, the rear face 541 is preferably oriented to downstream of the turbine.

A plurality of L-shaped legs 55 is attached to the wing 54 and distributed uniformly over the full circumference of the latter.

Each leg 55 is also incurved and has a general form of an arc of a circle of which the circle is coaxial to the ring 50, but has a radius larger than the radius of the ring 50. The leg 55 fits the shape of the ring 50.

Each L-shaped leg 55 has a short arm 551 called "fastening arm" and a long arm 552 called "retaining arm". The fastening arm 551 extends perpendicularly to a radius of the ring 50 and parallel to the longitudinal axis X1-X'1 of said ring. The retaining arm 552 extends circumferentially and at minimal distance from the rear face 541 of the wing 54 so as to form a slot 553 with the latter.

The long arm 552 has a front face 554 which extends opposite and parallel to the rear face 541 of the wing 54.

A part of the arm 551 constitutes the bottom 555 of the slot 553. The slot 553 is open opposite the bottom 555, between the free end of the long arm 552 and the wing 54.

Advantageously, at its free end the long arm 552 has a lug 556 (see FIG. 4) which projects from the front face 554 in the direction of the rear face 541 of the wing 54 so as to block the slot 555 partially only.

The arm 552 is advantageously slightly flexible.

Figure 2:
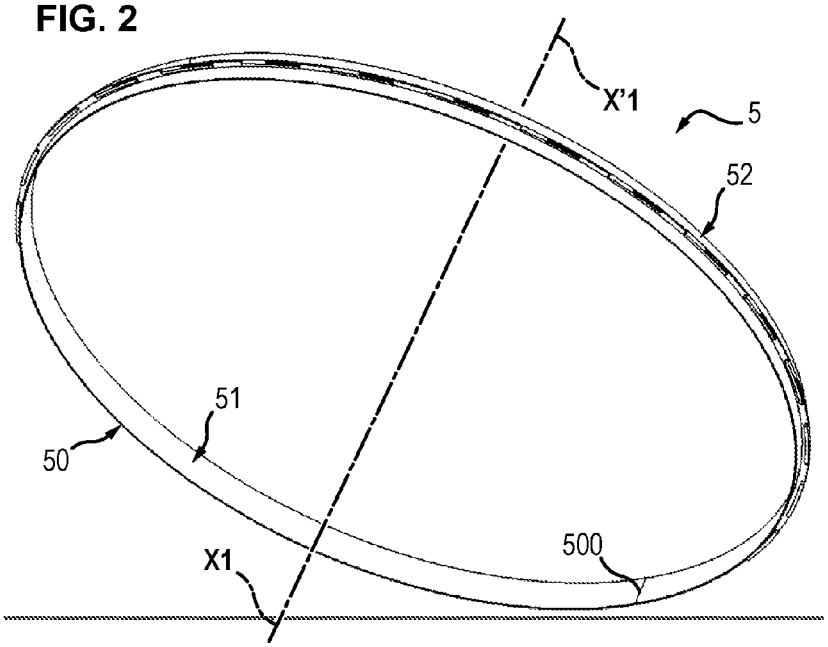
FIG. 2 is a perspective view of the collar of the nozzle according to the invention.

As seen more clearly from FIG. 2, it is evident that the ring 50 can optionally be split (see the longitudinal slot 500). This lends it some flexibility and makes it easier to mount the nozzle 4.

The different parts 50, 54 and 55 of the collar 5 are preferably monobloc, (made in a single piece). The collar 5 can be made by machining or by additive manufacturing, for example.

The collar 5 is preferably made of metal.

An example of embodiment of an angular nozzle sector 6 will now be described in conjunction with FIGS. 5 to 8.

Typically, this sector 6 comprises two angular sectors of platforms in an arc of a circle, coaxial, specifically a sector of external platform 61 and a sector of internal platform 62, connected together by several radial or substantially radial blades 63.

The different angular sectors 6 are assembled together around the collar 5, end-to-end circumferentially, so that the different angular sectors of external platform 61 jointly form the external platform of the nozzle 4 and the different angular sectors of the internal platform 62 jointly form the internal platform of the nozzle 4.

According to the invention, the angular sector of internal platform 62 is attached to a foot 621, called "internal radial foot", as it extends radially from the internal face of said sector of internal platform in the direction of the interior of the nozzle 4.

Figure 5:
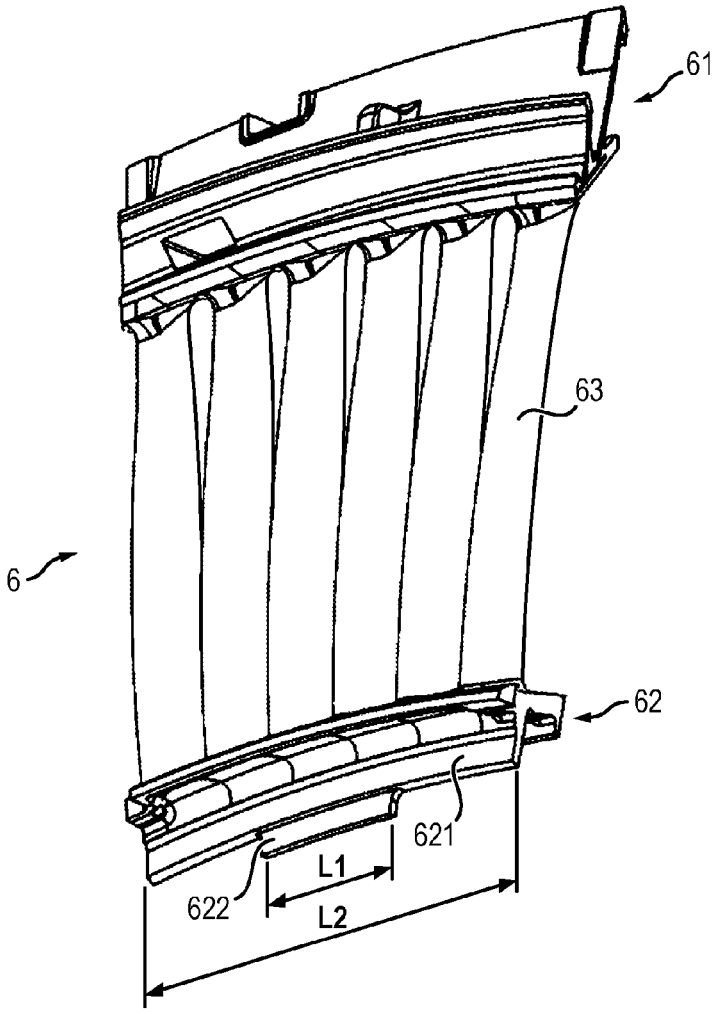
FIG. 5 is a perspective view of an angular nozzle sector according to the invention.

As is evident in FIG. 5, the internal radial foot 621 is incurved, viewed front on. It is extended radially towards the interior by a radial internal tab 622, also incurved, viewed front on.

Preferably, the tab 622 is centred in length relative to the internal radial foot 621 so as to avoid a cantilever.

The length of the tab 622 is preferably reduced to what it needs to absorb forces. Advantageously, the tab 622 has a length L1 tangentially, equal to around one third of the length L2 tangentially of the foot 621.

According to the variant embodiment shown here the foot 621 supports a single tab 622. But according to the dimensions of the angular sectors of nozzle 6, it is possible to have several tabs 622 on each foot 621.

Preferably, and as is more clearly seen in the sectional views of FIGS. 7 and 8, the tab 622 is not as thick as the foot 621 so that with this foot 621 it can form either a shoulder 623 which terminates on the front face 6211 of the foot 621 (see FIG. 7), or a shoulder 624 which terminates on the rear face 6212 of the foot 621 (see FIG. 8).

Advantageously and to further improve sealing, one or more sealing plates 7 can be fixed to the different angular nozzle sectors 6.

Figure 9:
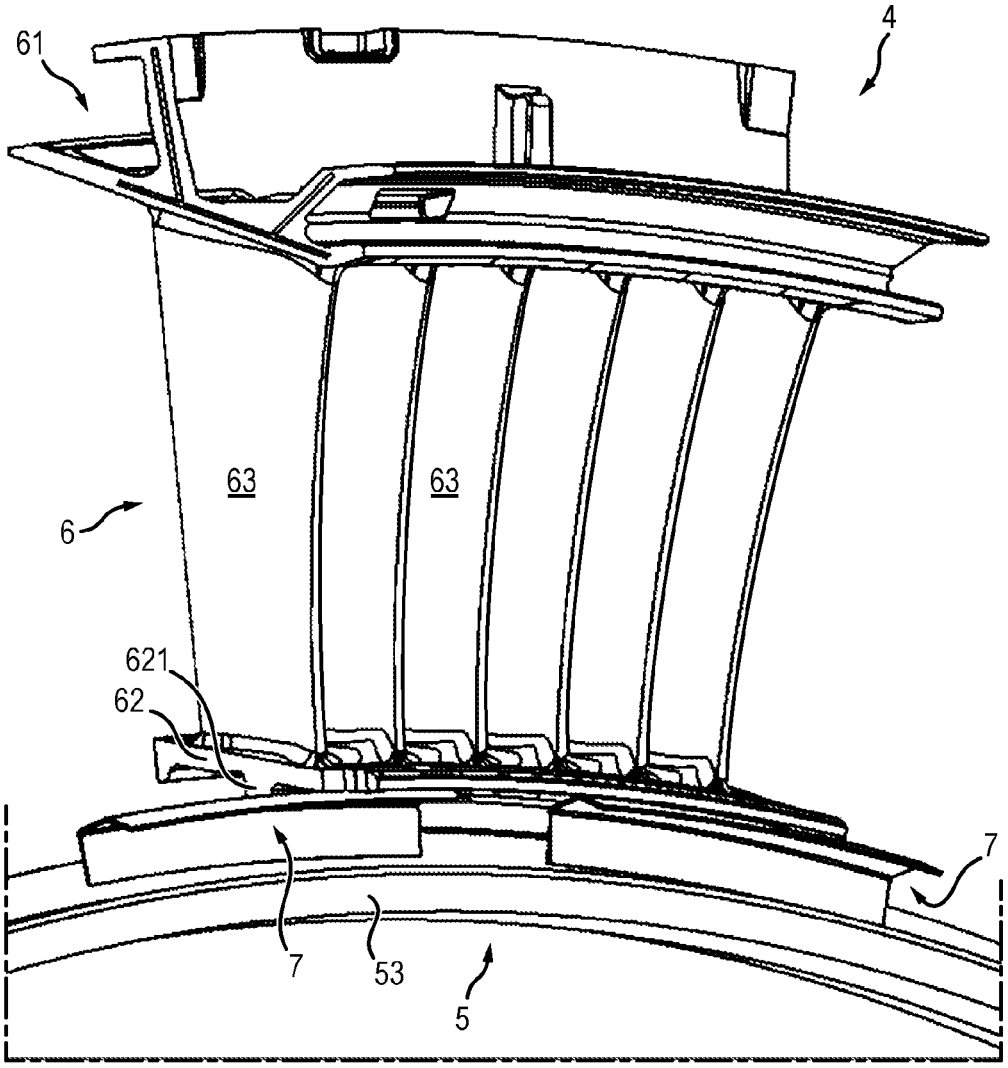
FIG. 9 is a perspective view of an angular nozzle sector, two shielding plates and part of the collar, assembled, which constitute part of a nozzle according to the invention.

As is evident in FIG. 9, the plate 7 is formed from a profile slightly curved in an arc of a circle, according to a circle of which the center is coaxial to the one of the circle of the internal platform 62 in an arc of a circle so as to mould to the form of this platform.

As is evident in FIGS. 7 and 8, in transversal section the plate 7 has a substantially L-shaped form, with a fastening flank 71 and a shielding flank 72.

The fastening flank 71 is intended to be fixed to the foot 621, for example by brazing or welding, this brazing or welding being able to be carried out intermittently or over the entire length of the plate.

Each flank 71, 72 can optionally have crease lines which define different facets so they can adapt to the different forms of feet 621, as can be seen in FIGS. 7 and 8, for example.

It is possible to have several segments of sealing plates 7, as shown in FIG. 9, these segments advantageously being fixed in the region of the intersection between two adjacent angular nozzle sectors 6 so as to limit air leaks at this site. It is also possible to have a single plate 7 which extends over 360°, closed in on itself in a ring or split. As shown in FIG. 11, it is possible to provide scalloping 710 on the lower part of its fastening flank 71 to reduce the mass of the plate 7.

The plate 7 fulfils both a sealing role by limiting leaks from inter-nozzle sectors 6 and a thermal shielding role with respect to the collar 5, the abradable material 53 and the other elements of the low-pressure turbine which are below this plate.

Figure 10:
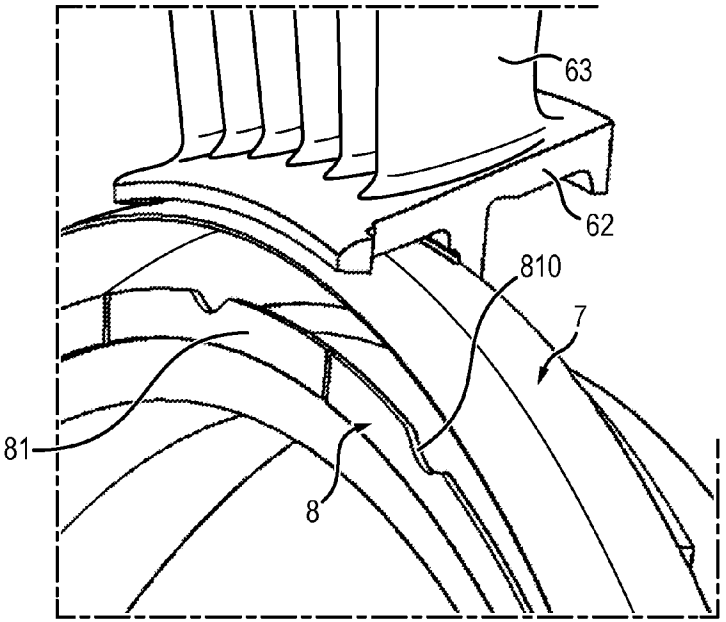
FIG. 10 is a detailed and perspective view of two different shielding plates joined together respectively on the collar and on an angular nozzle sector.

It is also possible to provide a complementary thermal shielding plate 8, shown in FIG. 10.

The plate 8 is arched, as is the shielding plate 7. It also has a substantially L-shaped transverse section with a fastening flank (not visible in the figure) intended to be fixed by welding or brazing onto the external face 52 of the collar 50 and a shielding flank 81 which extends substantially parallel to the feet 621.

As for the shielding plate 7, the plate 8 can be sectorised or extend over 360° and have scalloping 810, or not. Its role is to protect the collar 5 and direct the hot-air flow towards the blades 63.

Installing the different angular nozzle sectors 6 on the collar 5 will now be described in more detail.

Each angular sector 6 is mounted on the collar 5 so that its tab 622 is introduced laterally via the open end of the slot 553, then shifted in an anticlockwise direction, that is, to the left in FIG. 3.

The bottom 555 of the slot 553 plays the role of anti-rotation stop.

The rear 541 and front 554 faces constitute support faces for the tab 622 and limit its axial travel and therefore the axial travel of the corresponding angular sector 6.

As can be seen in the sectional views of FIGS. 7 and 8, the tabs 622 are preferably inserted into the slots 553 such that the shoulders 623 or 624 do not make contact with the wing 54 or the arm 552 respectively, effectively leaving slight radial play j1, respectively j2, between both, and allowing dilation of the different components.

Figure 6:
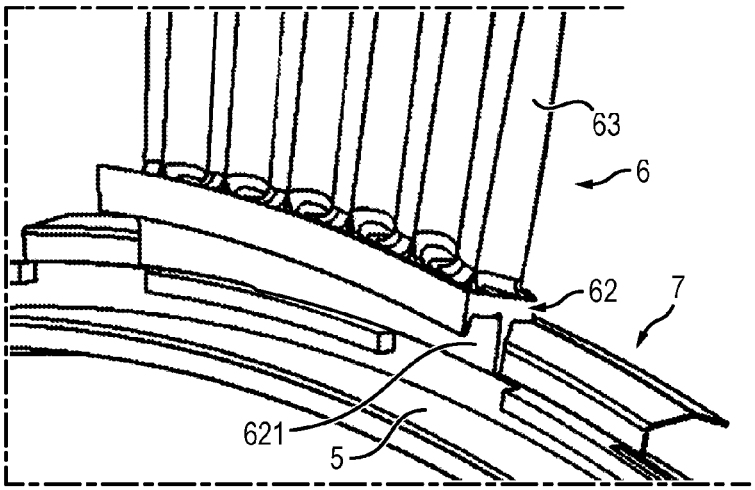
FIG. 6 is a perspective view of a portion of collar and of an angular nozzle sector assembled according to the invention.

FIG. 6 shows an angular nozzle sector 6 the tab of which is inserted into the slot of the coupling carried by the collar 5.

Finally, to prevent any risk of an angular sector 6 shifting, once the tab 622 is inserted into the slot 553 it is necessary to block the sector 6 relative to the collar 5.

Advantageously, the lug 556 prevents the tab 622 from disengaging, where the elasticity of the arm 552 is sufficient to allow introduction of the tab into the slot.

Figure 12:
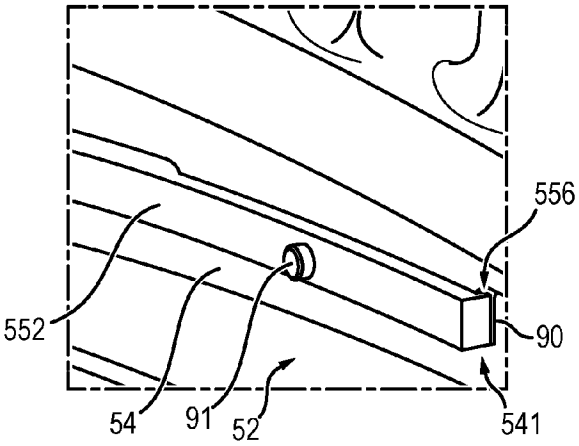
FIG. 12 is a detailed and perspective view of a fastening mode of an angular nozzle sector on the collar.

However, as shown in FIG. 12, it is also possible to add a welding point 90 between the lug 556 and the face 541 and/or a pin, a screw or a rivet 91 between the arm 552 and the wing 54.

The different angular sectors 6 are all positioned on the external casing of the turbine (see the casing 100 of FIG. 1). Next, the collar 5 is brought more closely to the tabs 622 so that each tab 622 is in front of the intake of a slot 553, and then the collar 5 is turned to the right in FIG. 3 to simultaneously engage all the tabs 622 in the slots 553.

The collar 5 is mounted in the turbine so that its axis X1-X'1 is joined to the axis X, X' of the turbine.

The invention has the following advantages:

The collar 5 is cylindrical in form with a fastening system via simple coupling. Its manufacture is therefore not expensive, especially given novel manufacturing processes such as additive manufacturing.

The abradable material 53 fixed to the collar 5 is now dissociated from the sectors 6 of the nozzle. Repairs made to the collar 5 or nozzle sectors 6 are therefore independent of each other, and this can simplify maintenance operations.

The invention also provides an overall gain in mass over the entire nozzle 4, since the collar 5 has less thickness than that of the base of an internal platform on a conventional angular sector.

The inter-sector clearances in the region of the internal platforms of adjacent nozzle sectors 6 are fully covered by the collar 5. Leaks from under the platform of the nozzle have sharply decreased.

Because of the collar 5, all the internal platforms 62 of the nozzle sectors 6 are aligned axially, which better controls axial clearances in the turbine, with beneficial impact on the performance of the engine.

The manufacturing cost, especially the casting cost for producing the nozzle, is also reduced as there is less material and there are fewer zones to control. It is no longer necessary to braze and machine the abradable material on each nozzle sector. Also, there is now no need to make slots on the internal platform 62, which causes a drop in costs and simplifies manufacturing.

Finally, the invention overall provides a considerable time gain during installation of the nozzle.

The invention claimed is:

1. A nozzle for a turbine, the nozzle-comprising:

several angular nozzle sectors, each angular sector comprising two sectors of respectively internal platform and external platform, in the form of an arc of a circle, coaxial, connected together by several radial or substantially radial blades, a radially internal foot being attached to each sector of internal platform, an annular collar on which said angular nozzle sectors are fixed end-to-end circumferentially, this collar comprising a cylindrical ring of which the radially internal face bears an abradable material, wherein the radially internal foot of each sector of the internal platform comprises a tab which extends radially towards the interior from said foot, and which extends circumferentially over part of the length of said foot, wherein the radially external face of said cylindrical ring bears an external radial wing, fitted with a plurality of L-shaped legs, wherein each L-shaped leg comprises a fastening arm and a retaining arm, wherein the fastening arm is attached to the external radial wing and extends perpendicularly to a radius of the ring and parallel to the longitudinal axis X1-X'1 of said ring wherein the retaining arm extends opposite this external radial wing and at minimal distance from the latter so as to form a slot with the external radial wing for receiving said tab of each angular nozzle sector, and wherein the slot is open at one of longitudinal ends of the slot to allow engagement of said tab to ensure fastening by coupling of said collar on each angular nozzle sector.

2. The nozzle according to claim 1, wherein said tab of the radially internal foot extends circumferentially over a third of the length of said foot.

3. The nozzle according to claim 1, wherein said tab extends circumferentially at the centre of the radially internal foot of each sector of internal platform.

4. The nozzle according to claim 1 wherein the end of the retaining arm is fitted with a lug projecting in the direction of the external radial wing to circumferentially retain said tab when the latter is engaged in the slot for receiving the tab.

5. The nozzle according to claim 1, wherein the retaining arm and the external radial wing are connected by a pin, a rivet and/or a weld.

6. The nozzle according to claim 1, wherein the nozzle comprises at least one sealing plate made of at least one segment of L-shaped or substantially L-shaped transverse cross-section, fixed to the radially internal foot of an angular nozzle sector so as to extend at least opposite the intersection between two adjacent angular nozzle sectors.

7. The nozzle according to claim 1, wherein the nozzle comprises at least one thermal shielding plate, made of at least one segment of L-shaped or substantially L-shaped transverse cross-section, fixed to the cylindrical ring of the collar.

8. A turbomachine turbine comprising at least one of the nozzle according to claim 1.

9. A turbomachine, wherein the turbomachine comprises the turbomachine turbine according to claim 8.

10. An aircraft turbojet, wherein the aircraft turbojet comprises the turbomachine turbine according to claim 8.

11. A turboprop, wherein the turboprop comprises the turbomachine turbine according to claim 8.

* * * * *